United States Patent [19]

Kausträter

[11] Patent Number: 4,519,292

[45] Date of Patent: May 28, 1985

[54] TURRET ASSEMBLY WITH ARTICULATED COVER FOR ACCESS OPENING

[75] Inventor: Gert Kausträter, Augsburg, Fed. Rep. of Germany

[73] Assignee: KUKA Wehrtechnik GmbH, Augsburg, Fed. Rep. of Germany

[21] Appl. No.: 398,909

[22] Filed: Jul. 16, 1982

[30] Foreign Application Priority Data

Jul. 22, 1981 [DE] Fed. Rep. of Germany ..... 3128861

[51] Int. Cl.[3] ..... F41H 5/20

[52] U.S. Cl. ..... 89/36.13

[58] Field of Search ..... 89/36 K, 36 L, 36 H, 89/36 C, 36 N, 37 E

[56] References Cited

U.S. PATENT DOCUMENTS 3,854,377 12/1974 Schiele ..... 89/36 K 4,398,447 8/1983 Harris et al. ..... 89/46

FOREIGN PATENT DOCUMENTS 2625789 12/1977 Fed. Rep. of Germany ..... 89/36 L 3128861 2/1983 Fed. Rep. of Germany ..... 89/36 K

*Primary Examiner*—Stephen C. Bentley

*Assistant Examiner*—John S. Maples

[57] ABSTRACT

A turret assembly for an armored vehicle has an opening in its top wall and a weapon chamber member therein below that opening. Pivotably mounted in the weapon chamber is a weapon carrier, and both the weapon carrier and the weapon chamber member are open at the top portions thereof aligned with the opening in the top wall of the turret to permit mounting and dismounting of the weapon from the exterior of the turret. A cover is pivotably secured to the carrier at the port end thereof and substantially closes the opening in the turret in combination with the carrier in its various pivoted positions. The cover is comprised of at least two articulated elements which move with the carrier in its pivoting and which are slidable relative to the turret top wall.

11 Claims, 5 Drawing Figures

TURRET ASSEMBLY WITH ARTICULATED COVER FOR ACCESS OPENING

BACKGROUND OF THE INVENTION

The present invention is directed to a novel turret assembly providing means for installing or removing the weapon either from the exterior of the turret or from the interior of the armored vehicle and yet providing secure coverage for the manned compartment of the armored vehicle.

In armored vehicles, it is desirable to provide a wide overhead port in the turret for installing and removing the weapon from the exterior. However, it is also generally necessary to have the weapon carrier accessible from the combat room or interior manned portion of the vehicle. Moreover, it is desirable that the manned combat chamber of the armored vehicle be effectively closed in all pivoted positions of the weapon carrier within the turret. Lastly, it is desirable to provide a turret assembly in which the weapon may be withdrawn from the weapon carrier from within the vehicle while at the same time keeping the manned chamber of the armored vehicle substantially closed to the exterior of the vehicle.

It is an object of the present invention to provide a novel turret essembly having elements which will permit opening of the turret for removal of the weapon to the exterior while at the same time providing a closure for the manned chamber of the armored vehicle.

It is also an object to provide such a novel turret assembly in which the weapon may be removed from the weapon carrier into the manned chamber of the armored vehicle while the turret assembly provides coverage for the opening to the manned combat chamber.

Another object is to provide such a turret assembly comprised of relatively readily fabricated parts which may be formed from rugged elements to provide long lived operation.

SUMMARY OF THE INVENTION

It has now been found that the foregoing and related objects can be readily attained in a turret assembly which includes a turret having a port for the barrel of a weapon in its front wall and a top wall with an opening therein, and a weapon chamber formed in the turret below the opening in the top wall. Mounted in the weapon chamber for pivotable movement below the turret opening is a weapon carrier, and the pivotable axis for the weapon carrier extends transversely of the weapon chamber. The carrier and the weapon chamber have sidewalls and openings in their upper portions adjacent to and aligned below the turret opening the front walls of the carrier and the weapon chamber have ports therein for a weapon mounted on the carrier in alignment with the port in the turret. A cover for the turret opening is pivotably secured at one end to the weapon carrier adjacent the upper end of its port, and the cover comprises at least two pivotably connected elements which are slidable relative to the turret top wall. As a result, the cover is movable with the weapon carrier during its pivotal movement and it is slidable relative to the turret top wall to provide a closure over the opening in the weapon chamber in the various pivoted positions of the weapon carrier.

In its preferred embodiment, the turret assembly includes an opening in the rear wall of the weapon chamber opposite the port therein. This opening is disposed along an imaginary line passing through the weapon chamber port and the pivot axis of the weapon carrier therein in an elevated pivoted position of the carrier. As a result, the associated weapon on the carrier can be removed therefrom and into the interior of the armored vehicle.

Desirably, the cover is provided by two pivotably connected elements, and the pivot means providing the pivotable connection therebetween limits the articulation therebetween. The top wall of the turret is essentially flat at least about the rearward portion of the opening therein, i.e., the end portion of the opening spaced from the ports. The adjacent or rear cover element is supported for sliding movement thereon. In position of pivoting of the weapon carrier bringing the ports of the carrier and chamber into alignment with the imaginary line through the port axis and the opening in the wall of the chamber member, the front element of the cover is also positioned essentially above the plane of the top wall.

In its preferred aspect, the turret assembly includes guides on the turret top wall adjacent the rear portion of the opening therein and in which the rear element of the cover is slidably received during pivotal movement of the weapon carrier. Magnetic means are also provided on the upper surfaces of the weapon carrier for magnetically engaging at least the rear element of the cover in preselected positions of the carrier.

DETAILED DESCRIPTION OF THE ILLUSTRATED EMBODIMENTS

Figure 1:
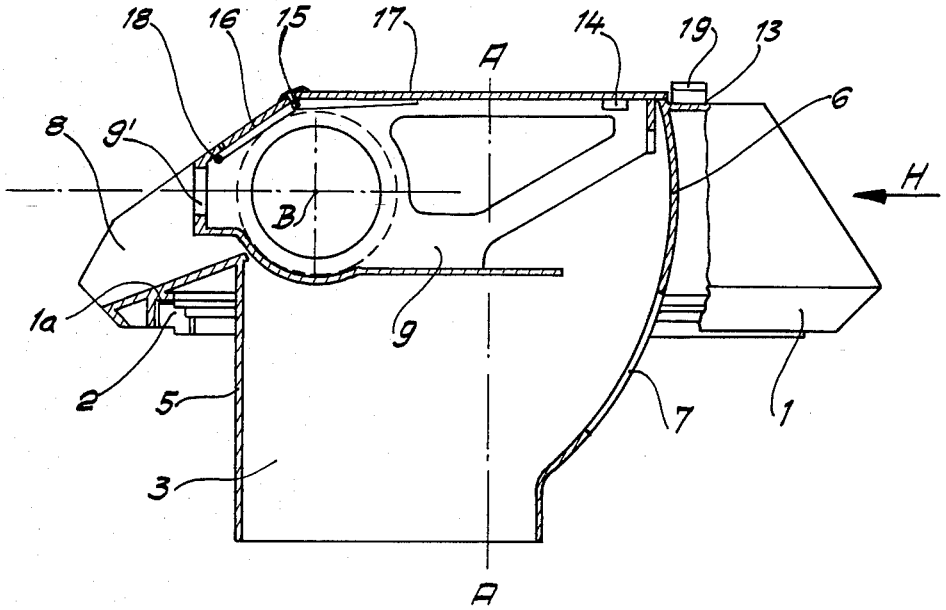
FIG. 1 is a longitudinal sectional view of a turret assembly embodying the present invention with the turret wall shown partially broken away and with the weapon carrier at zero elevation.
Figure 5:
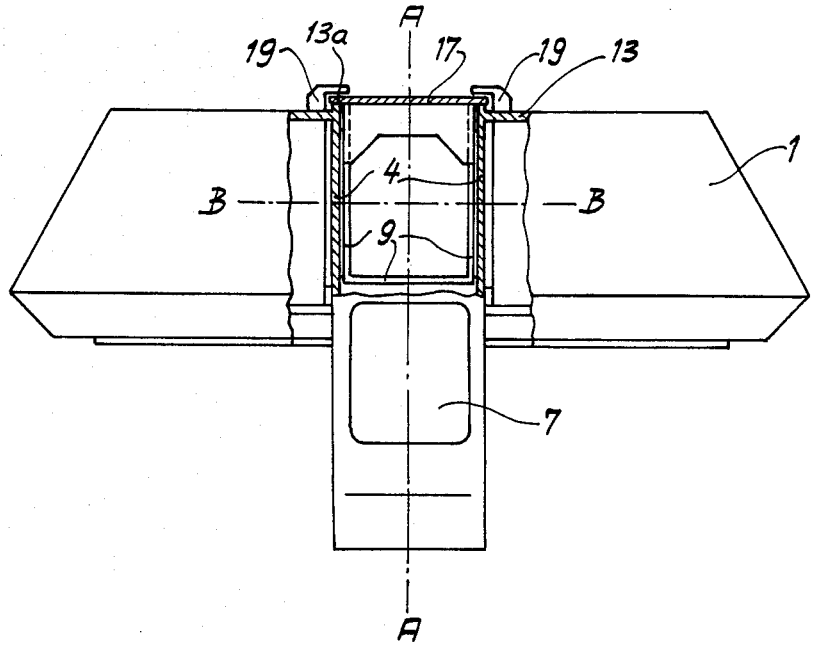
FIG. 5 is a partially sectional view of the turret assembly in the direction of the arrow H in FIG. 1.

Turning now to the attached drawings in detail and particularly to FIGS. 1 and 5, therein illustrated is an armored turret assembly embodying the present invention and which includes the armored turret generally designated by the numeral 1 which is disposed on an armored vehicle (not shown). The turret 1 is supported for rotation upon the armored vehicle upon the roller bearings 2 and will rotate or pivot in a horizontal plane defined by the upper surface 1*a* of the roller bearings 2 and about the vertical axis A—A seen in the several figures of the attached drawings.

Formed as a part of the turret 1 is a weapon chamber generally designated by the numeral 3 and which is defined by side walls 4, a front wall 5 having an outwardly offset upper portion and a rear wall 6 which tapers outwardly upwardly, all as seen in FIG. 1. The rear wall 6 has a opening 7 which is closable by a door (not shown), and the outwardly offset upper portion of the front wall 5 has an opening or port 8 in which is disposed the barrel receiving port 9′ of the weapon carrier generally designated by the numeral 9. The outwardly offset portion of the front wall 5 of the weapon chamber 3 is a part of the peripheral wall of the turret 1 and thus the port 8 therein also comprises the port in the turret 1 and the ports or openings in the chamber 3, turret 1, and weapon carrier 9 are aligned.

The weapon carrier 9 is pivotably supported in the side walls 4 of the weapon chamber 3 by pivot means (not shown) and is thereby pivotable about the horizontal axis indicated by the line B—B best seen in FIG. 5. The carrier 9 includes weapon bolting means 10 and 11 which will secure the weapon generally designated by the numeral 12 in the mounted position shown in phantom line in FIG. 3, by bolts passing through the bolt receiving apertures 10′ and 11′ as seen in the full line illustration of the weapon 12 in FIG. 3.

As best seen in FIG. 5, the turret 1 has a roof or top wall 13 with an opening with a width 13*a* substantially corresponding to the width between the side walls 4 of the weapon chamber 3 which is provided therein. The weapon chamber 3 is also open at its top and its opening is essentially coextensive with the opening 13*a*. Guide means 19 extend upwardly from the roof 13 at the rear of the opening 13*a* therein. As can be seen, the weapon chamber 3 and the weapon carrier 9, thus have openings 13*a* in their upper portions adjacent to and aligned below the opening in the turret top wall 13.

Figure 2:
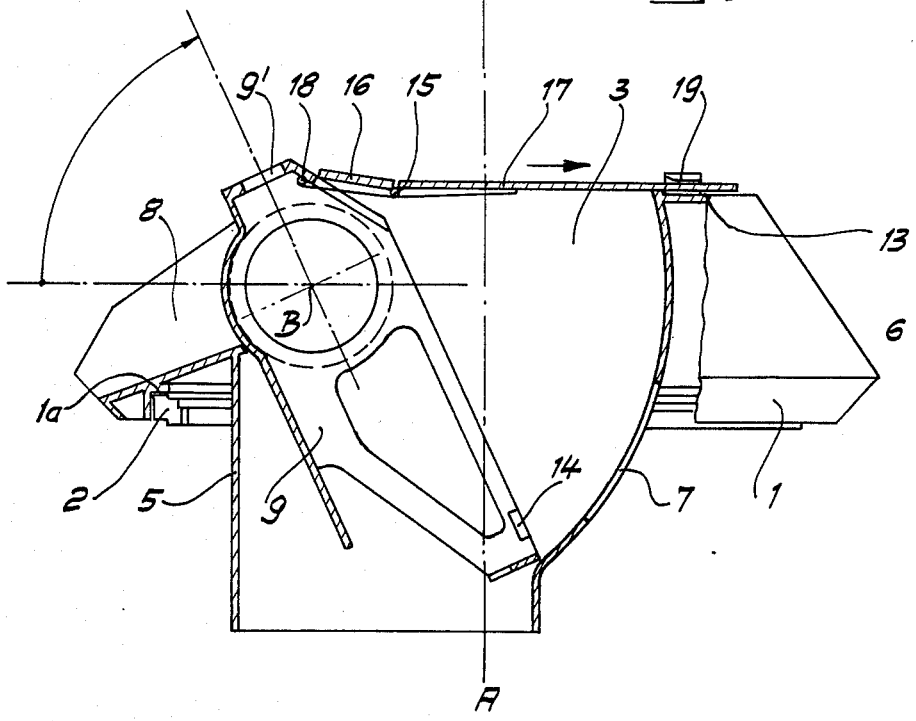
FIG. 2 is a similar view with the weapon carrier pivoted into its maximum elevation.
Figure 3:
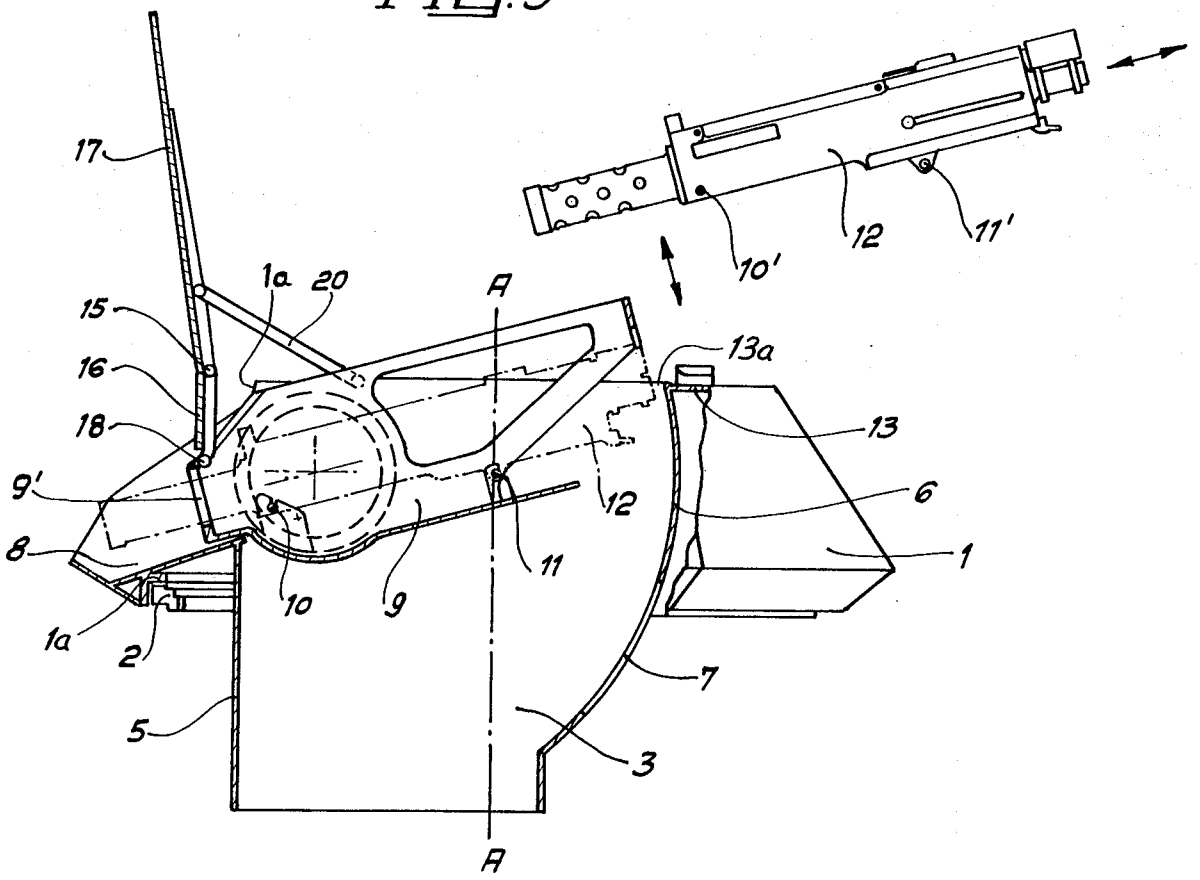
FIG. 3 is a similar view with the weapon carrier pivoted into a lowered elevation and with the overhead cover opened, a weapon being shown in mounted position in phantom line and shown in full line in a dismounted position.

Serving as a closure for the opening 13*a* in the turret roof 13 and in the weapon chamber 3 is an articulated sliding link cover comprised of the front element 16 and the rear element 17. The hinge pin 15 pivotably secures the two link elements 16, 17 together in a manner permitting them to pivot relative to each other as seen in FIGS. 1 and 2 but limiting the amount of relative pivoting so that the entire cover may be provided upwardly as a unit as seen in FIG. 3. The forward end of the front disc member 16 is in turn pivoted at the forward end of the weapon carrier 9 adjacent its port 9′ so that the cover moves concurrently therewith.

As a result, the weapon carrier 9, in its horizontal position shown in FIG. 1 is disposed so that the cover fully closes the aperture 13*a* in the roof 13 of the turret 1. When the weapon carrier 9 is pivoted upwardly to the position in FIG. 2, cover elements 16 and 17 slide rearwardly, and the element 17 slides over the rear portion of the roof 13 of the turret and within the guides 19 thereon. This permits the weapon carrier 9 to extend upwardly above the plane of the roof 13 while the cover maintains a closure over the remainder of the weapon chamber 3.

To mount the weapon 12 in the weapon carrier 9 from above the turret 1, it can be seen in FIG. 3 that the cover elements 16 and 17 may be pivoted into a substantially erect position and held in that position by the braces 20.

Magnets 14 on the upper surfaces of the weapon carrier 9 magnetically engage the rear cover element 17 so as to releasably retain it but permit the cover to be slidably moved upon the turret 1 into the position seen in FIG. 2 or pivoted upwardly into the position seen in FIG. 3.

Figure 4:
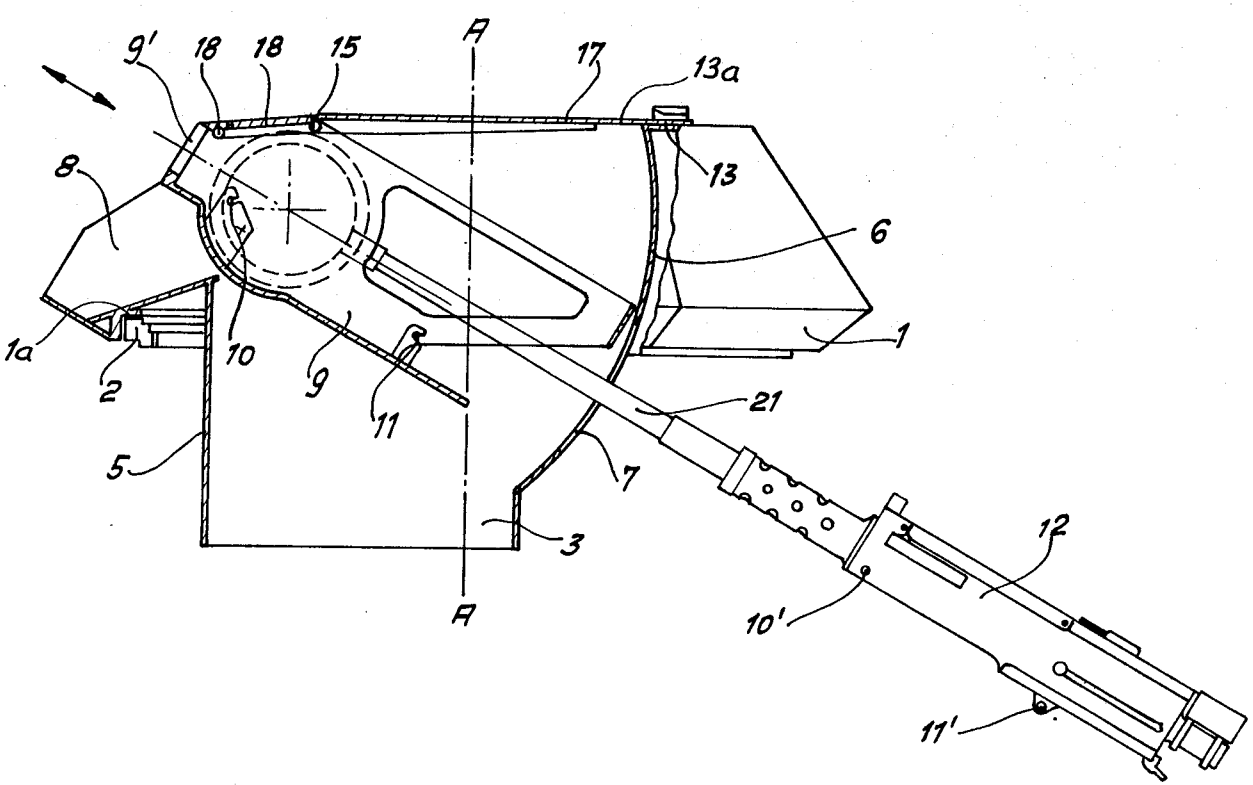
FIG. 4 is a view similar to FIGS. 1 and 2 with the weapon carrier disposed at an elevated position aligned with an opening in the weapon chamber and with the weapon shown dismounted therefrom and positioned for movement into its mounting.

In FIG. 4, it can be seen that, for installing or removing the weapon 12 from the interior of the vehicle, the carrier is pivoted so that the weapon mounting bolt positions 10 and 11 will be aligned with the opening 7 in the rear wall 6 of the weapon chamber 3. The weapon may then be moved longitudinally into the weapon carrier 9, or removed therefrom, as the case may be, from the combat room of the armored vehicle rather than from the exterior.

As seen in FIG. 2, the cover elements 16 and 17 of the cover will buckle only to a limited extent by reason of the articulate means at the pivot 15. Inward buckling is greatest in the horizontal position of the weapon carrier seen in FIG. 1. The same limitation of buckling provided by the articulation means 15 is operative in the position of the cover seen shown in FIG. 3.

Thus it can be seen that in any position of the weapon carrier 9, the combat room of the armored vehicle is substantially closed to the exterior either by the articulated cover 16, 17 or by the combination of the cover 16, 17 weapon carrier 9, and weapon chamber 3. Thus great safety is provided to the occupants of the armored vehicle even during assembly and disassembly of the weapon from the weapon carrier 9.

From the foregoing detailed specification and attached drawings can be seen that the turret assembly of the present invention provides significant protection for the combat room of the vehicle while permitting facile mounting and dismounting of the weapon from the weapon carrier and while providing a wide degree of elevation of adjustment of the weapon in the weapon carrier relative to the turret.

I claim:

1. In a turret assembly, the combination comprising:

A. a turret having a port in its front wall for the barrel of a weapon and a top wall with an opening therein;

B. a weapon chamber in said turret below said opening in said top wall;

C. a weapon carrier mounted in said weapon chamber for pivotal movement below said turret opening about an axis extending transversely of said chamber and said turret, said carrier and chamber each having openings in their upper portions adjacent to and aligned below said turret opening, the front of said carrier and weapon chamber each having openings therein providing ports aligned with each other and with said port in said turret, said ports providing the functional opening for the barrel of a weapon mounted on said carrier in alignment with said turret opening; and D. a cover for said turret opening extending rearwardly of and pivotably secured at its forward end to said weapon carrier adjacent the upper end of said port therein, said cover comprising at least two elements pivotably connected to each other, the forward one of which is pivotably secured to said weapon carrier adjacent the upper end of said port therein and the other element being spaced from said ports, said elements being freely slidably relative to said turret top wall, whereby said cover is movable with said weapon carrier during its pivotal movement and is slidable relative to said turret top wall to provide a closure for said turret opening over said weapon chamber in the various pivoted positions of said weapon carrier.

2. The turret assembly in accordance with claim 1 wherein said weapon chamber has an opening in its rear wall opposite said port therein, said opening being disposed along an imaginary line passing through said port and the pivotal axis of said weapon carrier therein in an elevated pivoted position of said carrier whereby an associated weapon on said carrier may be removed therefrom into the interior of the vehicle with said cover in a closed position for said turret opening.

3. The turret assembly in accordance with either claim 1 or claim 2 wherein said cover is provided by two pivotably connected elements and wherein the pivot means providing the pivotal connection therebetween is limited in its articulation.

4. The turret assembly in accordance with claim 2 wherein said top wall of said turret is essentially flat at least about the portion of said opening in said top wall spaced from said ports and wherein the one of said elements of said cover member disposed adjacent said flat wall is supported for sliding movement at a position of pivoting of said weapon carrier bringing said ports of said carrier and chamber into alignement with said imaginary line and said opening in the wall of said chamber, the other element of said cover also being movable into a position parallel to in the plane of said top wall.

5. The turret assembly in accordance with any one of claims 1 or 2 in which said assembly includes guides on said turret top wall adjacent said opening therein in which the element of said cover spaced from said ports is slidingly received.

6. The turret assembly in accordance with any one of claims 1 or 2 wherein said turret assembly additionally includes magnetic means on the upper surfaces of said weapon carrier for magnetically engaging at least the element of said cover spaced from said ports in the horizontal position of said carrier and in preselected pivoted positions of said carrier.

7. The turret assembly in accordance with claim 2 wherein said cover is provided by two pivotably connected elements, wherein the pivot means providing the pivotal connection therebetween is limited in its articulation, and wherein said assembly includes guides on said turret top wall adjacent said opening therein in which the element of said cover spaced from said ports is slidably received.

8. The turret assembly in accordance with claim 7 wherein said turret assembly additionally includes magnetic means on the upper surfaces of said weapon carrier for magnetically engaging at least the element of said cover spaced from said ports, in the horizontal position of said carrier and in preselected pivoted positions of said carrier.

9. The turret assembly in accordance with claim 2 wherein said cover is provided by two pivotably connected elements, wherein the pivot means providing the pivotal connection therebetween is limited in its articulation, and wherein said top wall of said turret is essentially flat at least about the end portion of said opening therein spaced from said ports, and wherein the element of said cover member disposed adjacent thereto is supported for sliding movement at a position of pivoting of said weapon carrier bringing said ports of said carrier and chamber into alignment with said imaginary line and said opening in the wall of said weapon chamber, the other element of said cover also being positioned essentially in the plane of said top wall.

10. The turret assembly in accordance with claim 9 in which said assembly includes guides on said turret top wall adjacent said opening therein in which the element of said cover spaced from said ports is slidingly received.

11. The turret assembly in accordance with claim 9 wherein said turret assembly additionally includes magnetic means on the upper surfaces of said weapon carrier for magnetically engaging at least the element of said cover spaced from said ports in the horizontal position of said carrier and in preselected pivoted positions of said carrier.

* * * * *

UNITED STATES PATENT AND TRADEMARK OFFICE

CERTIFICATE OF CORRECTION

PATENT NO. : 4,519,292

DATED : May 28, 1985

INVENTOR(S) : Gert Kaustrater

It is certified that error appears in the above—identified patent and that said Letters Patent is hereby corrected as shown below:

Column 5, line 18, the word "alignement" should be --alignment--.

Column 5, line 21, delete the word "in".

Signed and Sealed this

*Fifth* Day of *November 1985*

[SEAL]

*Attest:*

DONALD J. QUIGG

*Attesting Officer*

*Commissioner of Patents and Trademarks*